US005240196A

United States Patent [19]

Baarfuesser

[11] Patent Number: 5,240,196

[45] Date of Patent: Aug. 31, 1993

[54] CUTTING AND FEEDING APPARATUS FOR WEBS OF MATERIAL ON WINDING MACHINES

[75] Inventor: Johann Baarfuesser, Gauting, Fed. Rep. of Germany

[73] Assignee: BASF Magnetics GmbH, Mannheim, Fed. Rep. of Germany

[21] Appl. No.: 844,058

[22] Filed: Mar. 2, 1992

[30] Foreign Application Priority Data

Mar. 6, 1991 [DE] Fed. Rep. of Germany ..... 4107127

[51] Int. Cl.[5] ..... B65H 19/26

[52] U.S. Cl. ..... 242/56 R

[58] Field of Search ..... 242/56 R, 56 A, 56.6, 242/56.4, 56.5

[56] References Cited

U.S. PATENT DOCUMENTS

| | | | |
|---|---|---|---|
| 3,482,793 | 12/1969 | Mainstone | 242/56 R |
| 3,857,524 | 12/1974 | Melead et al. | 242/56 R |
| 3,908,924 | 9/1975 | Schulze | 242/56 R |
| 4,530,265 | 7/1985 | Lee et al. | 83/337 |
| 4,728,050 | 3/1988 | Luttge | 242/56 A |

FOREIGN PATENT DOCUMENTS

| | | |
|---|---|---|
| 1225014 | 9/1966 | Fed. Rep. of Germany . |
| 2418409 | 10/1975 | Fed. Rep. of Germany . |

*Primary Examiner*—John M. Jillions
*Attorney, Agent, or Firm*—Keil & Weinkauf

[57] ABSTRACT

Apparatus for cutting and renewed feeding of a running-in web of material, in particular on turning winders, the web (1) of material being pressed by a deflecting roller (5) against an empty winding sleeve (2), which it partially wraps around and, immediately after leaving the winding sleeve, a cutting knife (3), which extends transversely to the run of the web and is held on both sides by guide bands, cutting through the web from its lower side at the cutting point (12) and a feeding brush, firmly connected to the cutting knife, feeding the newly created beginning of the web to the winding sleeve. The entire cutting means can be swiveled away, so that a turning winder can be used to take off a finished-wound roll, fit an empty winding sleeve and turn the means, so that a new winding sleeve is able to be swiveled into the operating position (FIG. 1).

3 Claims, 2 Drawing Sheets

CUTTING AND FEEDING APPARATUS FOR WEBS OF MATERIAL ON WINDING MACHINES

FIELD OF THE INVENTION

Figure 1:
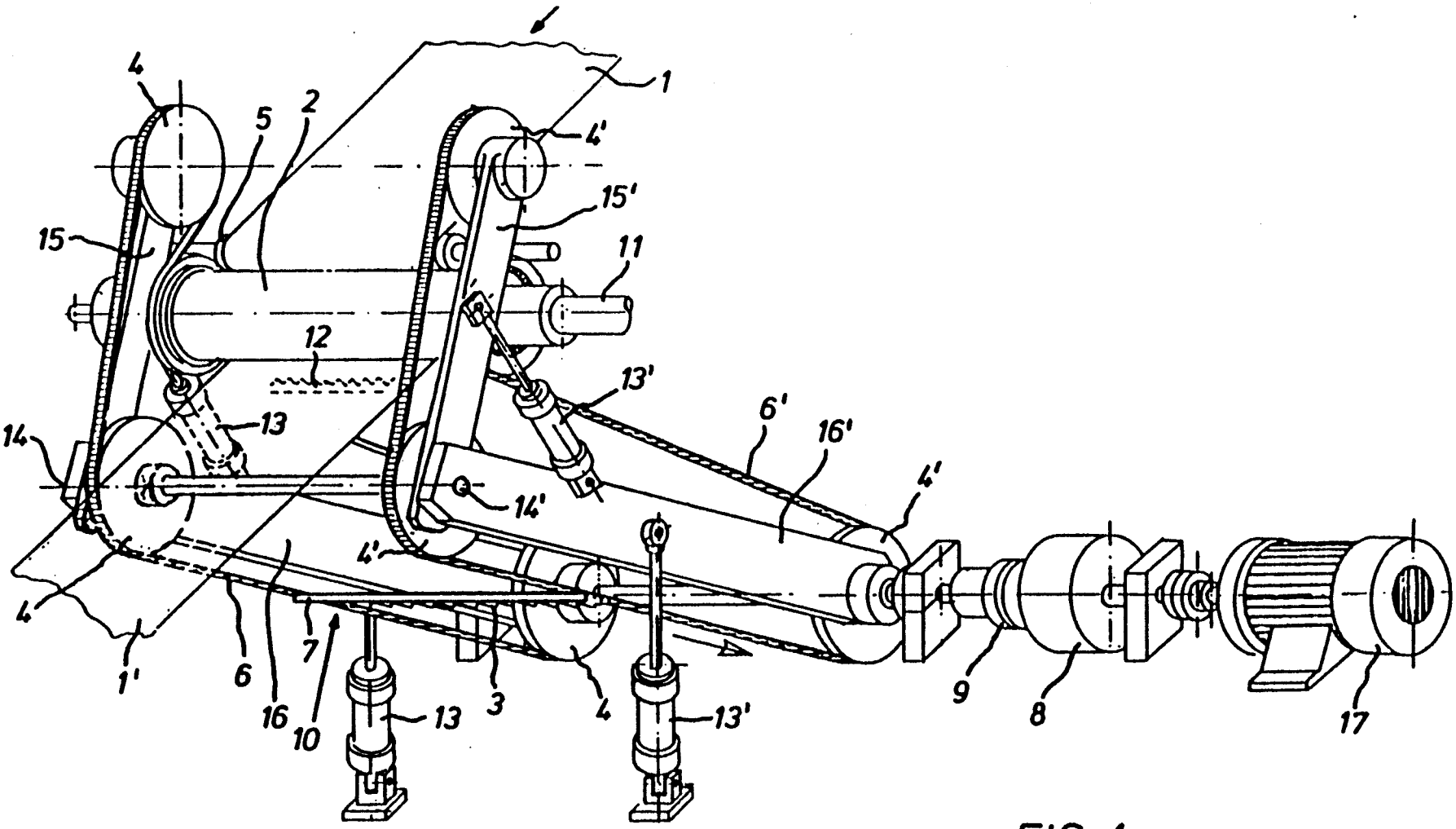

The invention relates to an apparatus for cutting and renewed feeding of a running-in web of material on winding machines to a winding sleeve, which is driven in rotation by means of a shaft, the running-in web of material being pressed against the winding sleeve by means of a deflecting roller partially wrapped around by the web of material and the running-off web of material being cut after leaving the winding sleeve by means of a cutting knife which extends transversely to the run of the web, can be driven by an energy accumulator and can be moved into the path of the web of material, and the new beginning of the web being fed to the winding sleeve by means of a brush.

BACKGROUND OF THE INVENTION

In the winding-up of webs of material, in particular by a multiple-up winding machine, it is important to switch the web from the finished-wound roll to an empty winding sleeve as quickly as possible in order to avoid wastage. After transversely cutting the web of material, the new beginning of the web is to be fed onto the empty winding sleeve without any folds. Transverse cutting and feeding apparatuses of this type are known from the prior art. In these apparatuses a carriage sliding transversely with respect to the web of material draws a knife transversely through the web and severs it immediately behind or on the empty winding sleeve wrapped around by the web. Other automatic transverse cutting and feeding apparatuses operate with a fixedly mounted smooth or serrated swivel knife, which cuts into the web to be cut and is driven electromotively or pneumatically. In the case of such apparatuses, there is the risk that, owing to the low starting speed, the knife will not reach a sufficiently high cutting speed on the short path to the cutting point, so that in transverse separating of the web of material a build-up occurs at the new beginning of the web and consequently folds form in the web of material on the winding sleeve, these folds having the effect that when a plurality of turns are wound one on the other they impair the quality of the web of material as impressions. Furthermore, it is known to achieve reliable feeding of the new beginning of the web to the empty winding sleeve by applying an adhesive strip or glue to the empty sleeve. However, this requires a special operation and, furthermore, in particular in the case of thin highly sensitive webs of material, for example magnetic tapes, a number of turns become unusable due to striking-through of the adhesive.

DE-A-2 418 409 discloses an apparatus of the generic type mentioned at the beginning. In this apparatus, for the running-off web, a swiveling frame is used to press a deflecting roller against the web between the empty winding sleeve and the full roll in such a way that the web wraps around the empty winding sleeve by more than half the circumference, whereupon the web of material is cut by a serrated cutting knife which is swivel-mounted on the spindle of the deflecting roller and driven by a torsion-bar spring. The cutting knife bears on the side facing away from the deflecting roller a brush which, upon the swiveling movement of the cutting knife, smooths the web against the empty winding sleeve.

DE-A-2 232 336 describes an apparatus for cutting and refeeding a web of material on a winding sleeve, the running-off web being cut between the empty winding sleeve and a deflecting element by a cutting element which is driven by a pneumatic or hydraulic drive via a rack and a toothed segment, the cutting element being swiveled coaxially with respect to the winding sleeve and subsequently an air box connected to the cutting element pressing the beginning of the web against the winding sleeve.

The prior art also discloses feeding systems which operate with cutting apparatuses which cut on the winding sleeve and require special winding sleeves with cutting grooves on the core. However, in these cases, over the course of time, the cutting operation damages the core, which together with the grooves in the core causes deformations in the web of material rolled up.

SUMMARY OF THE INVENTION

It is therefore an object of the present invention to provide an apparatus of the generic type mentioned at the beginning which permits both reliable severing of a running web of material and feeding of the new beginning of the web to the winding sleeve, even at high speeds, at the same time ensuring good cutting quality and no folds when the beginning of the web is fed to the winding sleeve.

We have found that this object is achieved by an apparatus for cutting and renewed feeding of a running-in web of material on winding machines comprising a winding sleeve, which is driven in rotation by means of a shaft, the running-in web of material being pressed against the winding sleeve by means of a deflecting roller partially wrapped around by the web of material, a cutting knife, which extends transversely to the run of the web, and which is driven by an energy accumulator and is moved into the path of the running-off web of material after leaving the winding sleeve, wherein the cutting knife is held on both sides by guide bands, which run over rotatable deflecting rollers, the cutting knife being accelerated with respect to the running web of material in such a way that its speed is greater than the running speed of the web of material, a feeding brush firmly connected to the separating knife and extending transversely to the web of material, which feeds the new beginning of the web to said winding sleeve after the cutting of the web of material. Further details of the invention emerge from the subclaims, the drawings and the description.

SHORT DESCRIPTION OF THE DRAWINGS

Figure 2:
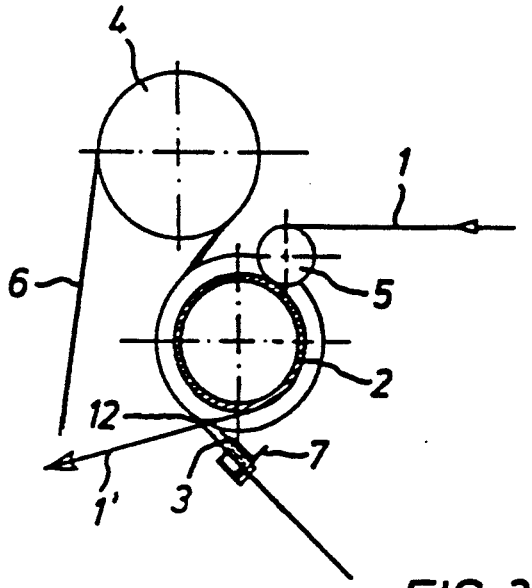
Figure 3:
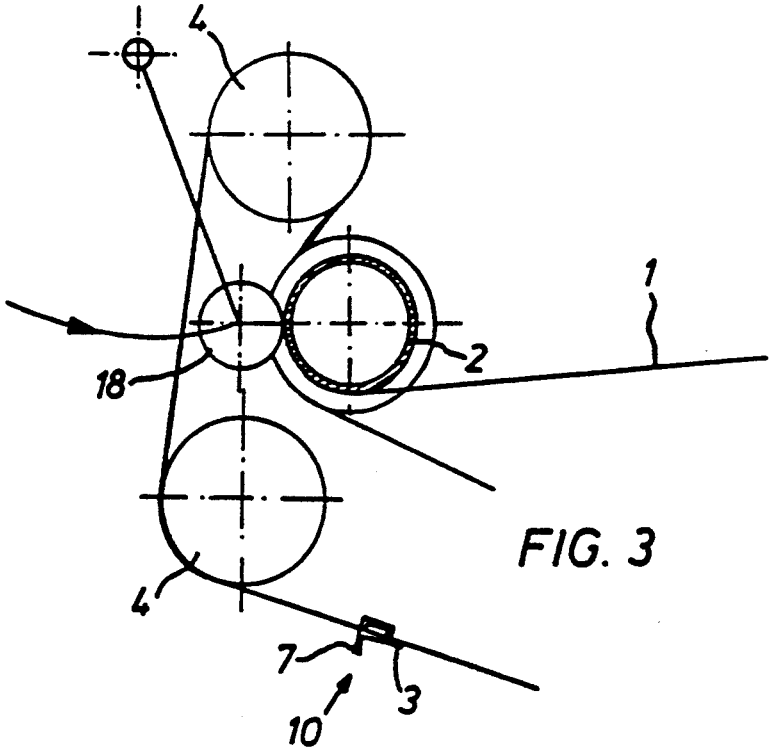

The invention is explained in further detail below with reference to the drawings, in which:

FIG. 1 shows a perspective representation of the apparatus according to the invention, FIG. 2 shows a cross-section through the apparatus before cutting of the web, FIG. 3 shows the analogous apparatus after cutting of the web.

PREFERRED EMBODIMENT OF THE INVENTION

The run of the web can be seen from FIGS. 1 and 2. The web (1) of material running in in the direction of the arrow is pressed by means of a deflecting roller (5), which can be swiveled against it and over which it runs with its lower side, with its upper side against the winding sleeve (2), it wrapping with its upper side around part of the circumference of the winding sleeve. The winding sleeve (2) is drive-mounted on the shaft (11). After leaving this winding sleeve, the running-off web (1') of material is fed to a winding roller (not drawn) and wound up on it until reaching the full roll diameter. The apparatus for cutting and renewed feeding of a running-in web of material comprises a cutting knife (3), which extends transversely to the run of the web and is fastened on both sides to guide bands (6, 6'). These bands may be a circulating chain or a belt, a rope or the like. The circulating bands are led over rollers or sprockets (4, 4'), which must be mounted in a free-running and easy-acting manner and are located in the region of the winding sleeve (2) outside the core tensioning means. A feeding brush (7), which extends at right angles to the cutting knife (3), is firmly connected to the said knife.

The entire apparatus for cutting and refeeding (3, 4, 4', 6, 6', 7) may be of a two-armed design as can be seen from FIG. 1, the two arms (15, 15', 16, 16') being connected to each other on both sides by means of joints (14, 14') and constructed in such a way that it can be swiveled away by displaceable cylinder guides (13, 13'), so that the entire separating means can be swiveled away temporarily for the purpose of turning the winding means.

The operation of cutting and refeeding the web of material proceeds as follows. After reaching the full roll circumference on the winding sleeve, the cutting means is prepared for the cutting operation by a flywheel mass (8) being driven by means of the electric motor (17) via a spindle, setting the rollers (4, 4') connected to it in accelerated rotation via a flanged-on coupling (9) and moving the cutting knife (3) by means of the guide bands toward the separating point (12), which lies immediately next to the circumference of the winding sleeve (2) in the region of the running-off web (1') of material. At the instant when the cutting knife (3) makes contact with the web (1') of material, the speed of the cutting knife must be greater than the running speed of the sheet web. In this way, the way, the cutting knife overtakes the newly created beginning of the web, and the smoothing brush (7), which is directed radially toward the circumference of the empty sleeve (2), smooths the beginning of the web firmly onto the winding sleeve. After completing the cutting operation, the cutting means (3) is slowed down again by means of the guide bands and the guide rollers and returned to the position of rest (10), which is at the same time the starting position. After that, the full web roll can be removed from the turning winder, whereupon an empty winding sleeve is fitted in its place.

Following this, the cutting and feeding apparatus described is swiveled completely away. A pressure roller (18) opposite the deflecting roller (5), is swiveled against the circumference of the winding sleeve (2) on which material is to be newly wound, whereas the deflecting roller (5) is swiveled away. By swiveling the turning winder through 90° to 180°, depending on the number of winding sleeves, the positions of the winding sleeves are exchanged. At least until this operation has been completed, the pressure roller (18) remains swiveled against the newly created roll. The cutting and feeding apparatus is brought back into its operating position. At the latest shortly before the new roll has reached the desired diameter, the web of material is pressed by the deflecting roller (5) against the empty winding sleeve (2) and the cutting and feeding apparatus is set in motion by the motor (17). The cutting and changing operation can begin anew.

It is essential for the invention that the cutting knife (3) with the feeding brush (7) is taken very closely past the circumference of the winding sleeve (2), so that a good cutting quality is achieved and at the same time the newly created beginning of the web is fed to the winding sleeve in a reliable way. The structural design of the separating apparatus, with which the separating knife is guided by means of bands, makes it possible by having an adequate length of the accelerating distance to achieve the desired cutting speed, which can still be attained even at high running speeds of the web of material. In this case, the accelerating distance of the cutting knife is preferably approximately the same length as the slowing distance.

I claim:

1. Apparatus for cutting and renewed feeding of a running-in web of material on winding machines comprising a winding sleeve, which is driven in rotation by means of a shaft, the running-in web of material being pressed against the winding sleeve by means of a deflecting roller partially wrapped around by the web of material, a cutting knife, which extends transversely to the run of the web, and which is driven by an energy accumulator and is moved into the path of the running-off web of material after leaving the winding sleeve, wherein the cutting knife is held on both sides by guide bands, which run over rotatable deflecting rollers, the cutting knife being accelerated with respect to the running web of material in such a way that its speed is greater than the running speed of the web of material, a feeding brush firmly connected to the cutting knife and extending transversely to the web of material, which feeds the new beginning of the web to said winding sleeve after the cutting of the web of material.

2. Apparatus as claimed in claim 1, wherein the cutting knife is driven out of its position of rest (10) by means of an electric motor (17), which can be switched in by a coupling (9), and a flywheel mass (8) and, after running through the cutting point (12) of the web of material, which lies immediately adjacent to the circumference of the winding sleeve (2), is slowed again and returned to the position of rest (10), the accelerating distance being approximately equal to the length of the slowing distance.

3. Apparatus as claimed in claim 1, wherein, in the case of multiple-up winding machines, on which a turning winder can be used to swivel a finished-wound roll into a take-off position and at the same time an empty winding sleeve can be swiveled into an operating position, the entire cutting means (3, 4, 4', 6, 6', 7) is mounted in such a way that, to permit the turning operation of the turning winder, it can be swiveled in and away by means of displaceable cylinder guides (13, 13'), which act on two arms (15, 15', 16, 16') on both sides of the web of material, which are able to be articulated via a joint (14, 14').

* * * * *